US006656248B2

(12) United States Patent
Ilmasti

(10) Patent No.: US 6,656,248 B2
(45) Date of Patent: Dec. 2, 2003

(54) METHOD AND APPARATUS TO CLEAN AIR

(75) Inventor: Toni Niko Ilmasti, Helsinki (FI)

(73) Assignee: Moira Ltd., Helsinki (FI)

( * ) Notice: Subject to any disclaimer, the term of this patent is extended or adjusted under 35 U.S.C. 154(b) by 0 days.

(21) Appl. No.: 09/968,859

(22) Filed: Oct. 3, 2001

(65) Prior Publication Data

US 2003/0061934 A1 Apr. 3, 2003

(51) Int. Cl.[7] ..... B03C 3/76

(52) U.S. Cl. ..... 95/74; 55/429; 55/433; 55/DIG. 38; 96/29; 96/39; 96/94; 96/97

(58) Field of Search ..... 96/97, 29, 39–41, 96/94, 63; 95/74, 77; 55/433, 429, 432, DIG. 38

(56) References Cited

U.S. PATENT DOCUMENTS 1,908,897 A * 5/1933 Heinrich ..... 96/29
2,409,579 A * 10/1946 Meston ..... 96/97
2,712,362 A * 7/1955 Winklepleck ..... 96/29
3,343,344 A * 9/1967 Fairaizl et al. ..... 55/376
3,765,154 A * 10/1973 Hardt et al. ..... 96/88
3,768,258 A * 10/1973 Smith et al. ..... 60/275
4,247,307 A * 1/1981 Chang ..... 95/79
4,689,951 A * 9/1987 Polach ..... 60/275
5,254,155 A * 10/1993 Mensi ..... 96/44
5,277,703 A * 1/1994 Sklenak et al. ..... 95/77
6,126,727 A * 10/2000 Lo ..... 96/39
6,187,078 B1 * 2/2001 Huang ..... 95/74

* cited by examiner

*Primary Examiner*—Richard L. Chiesa
(74) *Attorney, Agent, or Firm*—Burns, Doane, Swecker & Mathis, L.L.P.

(57) ABSTRACT

The invention relates to a method to clean air for separating materials in the form of particles and/or droplets from a gas flow. The gas flow is directed through a collection in which the outer walls are grounded, and in which high voltage is supplied to the ion yield tips arranged in the collection chamber. Thus an ion beam from the ion yield tips towards collection surfaces is established to separate desired material from the gas flow. The electrically conductive collection surfaces are electrically insulated from the outer castings and high voltage is supplied to the collecting surfaces, in which the direct-current voltage has an opposite sign as the high voltage directed to the ion yield tips. The collection surface is totally conveniently and rapidly detached for clean material replacement.

12 Claims, 1 Drawing Sheet

METHOD AND APPARATUS TO CLEAN AIR

BACKGROUND OF THE INVENTION

The present invention relates to a method for separating materials in the form of particles and/or drops from a gas flow, in which method the gas flow is directed through a collection chamber, the outer walls of which are grounded and in which method high voltage is directed to the ion yield tips arranged in the collection chamber so that an ion beam separating the desired materials from the gas flow is achieved towards the walls working as collection surfaces and where the collection surfaces are electrically insulated from the outer walls and a high voltage is directed to the collection surface having a counter-direct-current voltage as to the high voltage directed to the ion yield tips.

The purpose of the method according to the invention is to provide protection in shields such as bomb shelters to clean air and to protect the people present in the said shelter. Earlier applied air cleaning solutions, in the said shelters, use various fiber filters, various electronic precipitators, air cleaning methods based on ion blow or electrophoresis and grounded collection surfaces applied in the method, air cleaning methods based on ion blow and collection surfaces of opposite electronic charge applied in the method, air cleaning methods based on fiber filter media and sand precipitation.

The disadvantages of the above mentioned, well-known solutions are:

The precipitation effect of fiber filters is limited by particle size incapable to separate small particles from air such as chemical compounds and nuclear.

The precipitation effect of fiber filters is limited by particle size incapable to separate small particles from air such as chemical compounds and nuclear pollution used as biological weapons. The major disadvantage of fiber filters is the blocking effect due to the huge number of atmospheric particles or droplets. This is why these do not meet requirements for sheltering room areas.

Electronic precipitators require in sheltering room spaces prefiltering by fiber filters to prohibit fibrous particles from penetrating into the filter media. As mentioned before, fiber filters are not applicable to be utilized in such areas, and neither to be utilized solely.

Air cleaning methods based on ion blow and grounded collection surfaces are based on high voltage 100 to 150 kV, which make the voltage suppliers heavyweight, robust and expensive. This is why such methods are discarded when arranging economic air cleaning specifically in restricted, individual inhabitant shelters.

Air cleaning based on ion blow and oppositely charged collection surface, utilizes flushing liquid or dry cleaning to drop down the collected material. This is why the collection surface must be vertical as both flushing and mass dropping are based on gravitational phenomena. These methods use collection surfaces on solid insulated casings.

Fiber filters and sand precipitators are the most common air cleaning methods in inhabitant shelters. If a fiber filter is used, there is always a potential risk for blocking. If sand precipitation is the single method, penetration of small particles cannot be prohibited, which means that a number of chemical compounds and nuclear pollution penetrate the filtering;

OBJECTS AND SUMMARY OF THE INVENTION

The purpose of this invention is to eliminate the above mentioned disadvantages. Method according to this invention is characterized by a collection surface, which is compact and conveniently and totally replaced.

The invention also relates to a device comprised of a collection chamber with grounded outer walls, ion yield tips arranged in the collection chamber where a high voltage is directed to the ion yield tips, of an electronically conductive collection surface, in the collection chamber, where the collection surface is electrically insulated from the outer casing and a high voltage is supplied to the collection surface having an opposite direct-voltage than the high voltage supplied to the ion yield. The collection surface can optionally be angular or designed from individual plates. The device according to the invention is characterized in that the collection surface is totally rapidly and conveniently replaced.

The decisive advantage of the invention is the simple use of the air cleaning unit, where all cleaning, flushing or control arrangements are unnecessary.

A decisive advantage is the simple use of the air cleaning device, as neither cleaning nor control arrangements are required. Electronic methods handling dry mass material, require additionally electronic control to alter the electronic charge potential and remove the mass, which in this invention is unnecessary.

Removal of unnecessary elements as mentioned above accomplishes cost-efficient manufacture and increased safety in use.

This invention is not limited by any direction or position of the collection surface which may be arbitrary, for example, horizontal or vertical. An advantage of the device according to this invention is also mounting of the air cleaning device to penetrate the outer construction wall for the supply of fresh clean air into the sheltered indoor area.

Replacement of the collection surface using a protective covering bag enables removal and discarding of collected contaminated material for disposal or transportation to a hazardous waste treatment plant.

Various application models of the invention have been shown in the independent patent claims in the claim settings.

BRIEF DESCRIPTION OF THE DRAWINGS

The invention is described in more detail using examples referring to the enclosed Figures, where.

DETAILED DESCRIPTION OF THE PREFERRED EMBODIMENTS OF THE INVENTION

Figure 1:
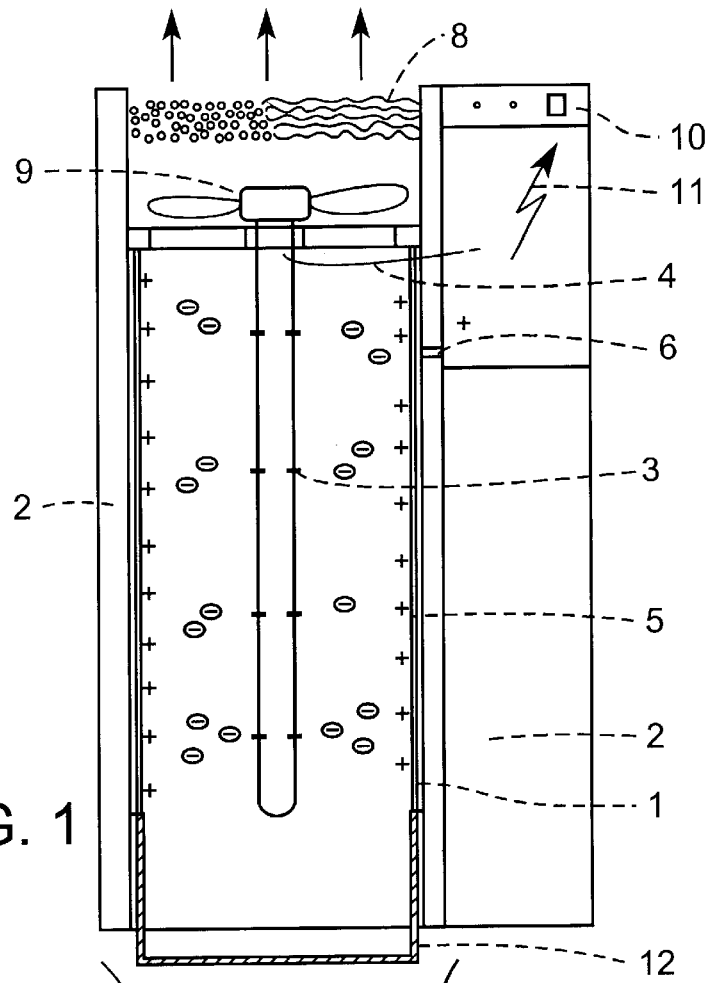
FIG. 1 shows a model of the air cleaning device as a cross-section.
Figure 2:
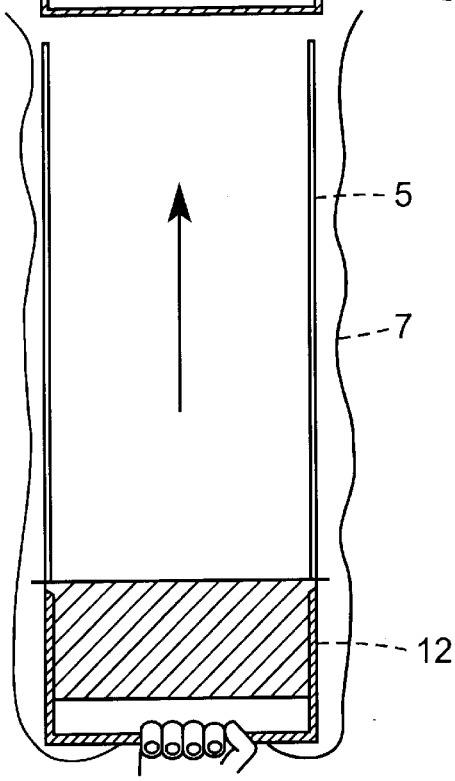
FIG. 2 shows the collection surface furnished with a disposable covering protection bag detached from the air cleaning unit.
Figure 3:
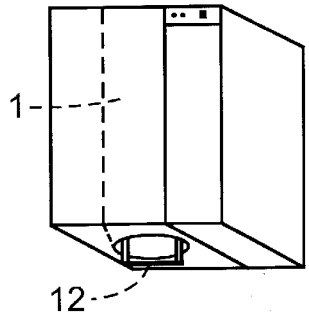
FIG. 3 shows an axonometric drawing of the air cleaning unit diagonally from the bottom.

The air cleaning device consists of a collection chamber 1, the outer surfaces of which are grounded 2. The collection chamber comprises ion yield tips 3, whereto a high voltage 4 is supplied. The electrically conductive collection surface 5 in the collection chamber is electrically insulated from the outer casing 2. A high voltage 6, having an opposite direct-current voltage than the conducted voltage supplied to the ion yield tips 3, is supplied to the collection surface 5. The collection surface 5 is detachable and is totally rapidly and conveniently replaced. Replacement of the collection surface 5 is performed by using a protective covering bag 7, which separates the contamination and thus prohibits the material from spreading into the surrounding air and environment. In the exhaust area of the device there is a gas absorbing module 8, which is of a cassette form and convenient to replace. In between of the collection chamber 1 and the module 8, there is a fan 9, which generates an air current in the device. A control and adjustment unit 10 and a high voltage supply unit 11 are parts of the construction, too. An electrically insulated handle 12 is attached to the collection chamber 5. The replacement of the cleaning chamber is easy to perform using the handle 12.

It is obvious for one skilled in the art that the method and device to clean air, in which materials in the form of particles and/or drops are separated from a gas flow and in which replacement of a collection surface is rapidly and conveniently performed using detachable, disposable protective bags, are not limited to the example described above, but they are based on the following claims.

What is claimed is:

1. Method to clean air, where materials in the form of particles and/or droplets are separated from the gas flow, in which method the gas flow is directed through a collection chamber towards the outer casings, which are grounded and in which method high voltage is supplied to ion yield tips, in which the ion beam from the ion yield tips towards the collection surfaces separates the desired materials and in which the electrically conductive collection surfaces are insulated from the outer casings and a high voltage is supplied to the collection surface having an opposite direct-voltage than the high voltage supplied to the ion yield tips, wherein the collection surface is totally rapidly and conveniently replaceable, and replacement of the collection surface is performed using a protective covering bag which separates the collected material and prohibits the material from spreading into the surrounding indoor environment.

2. Method according to claim 1 characterized in that the replacement of the collection surface is performed by an insulated construction.

3. Device for air cleaning comprising a collection chamber in which the outer walls are grounded ion yield tips inside of the collection chamber, into which a high voltage is supplied a conductive collection surface, which is insulated from the outer casings and into which a high voltage is supplied having an opposite direct-charge voltage than the high voltage supplied to the ion yield tips, wherein the collection surface comprises a detachable module having means for totally conveniently and rapidly replacing said module, said replacing means comprising a protective covering bag for insulating the collected contamination and prohibiting the collected contamination from spreading into the surrounding environment.

4. Device according to claim 3 characterized in that the replacement of the collection surface is performed using an insulated construction.

5. Device according to claim 4 characterized in that the electrically insulated construction is equipped with a handle.

6. Device according to claim 3 characterized in that the collection surface is tubular in shape.

7. Device according to claim 3 characterized in that the collection surface is round.

8. Device according to claim 3 characterized in that the collection surface is angular.

9. Device according to claim 3 characterized in that the collection surface is designed from individual plates.

10. Device according to claim 3 characterized in that there is a gas absorbing module which is of cassette form and convenient to replace.

11. A method for separating desired materials from a gas, the method comprises:

(i) providing a device comprising a collection chamber with grounded outer walls, at least one collection surface disposed within the collection chamber, an electrically insulated handle attached to the at least one collection surface, and ion yield tips;

(ii) directing air flow through the collection chamber;

(iii) applying a voltage between the ion yield tips and the at least one collection surface;

(iv) collecting the desired material upon the at least one collection surface;

(v) separating and manually removing the at least one collection surface from the device by grasping the electrically insulated handle; and (vi) enveloping the at least one collection surface with a protective bag while removing the at least one collection surface.

12. The method of claim 11, further comprising:

(vii) disposing of the at least one collection surface; and (viii) introducing a new at least one collection surface into the device.

* * * * *